US006138384A

United States Patent [19]

Messmer

[11] Patent Number: 6,138,384

[45] Date of Patent: Oct. 31, 2000

[54] SNOWBOARD BOOT WITH INNER STIFFENING ASSEMBLY

[75] Inventor: Karl Messmer, Goldach, Switzerland

[73] Assignees: Salomon S. A., Metz-Tessy, France; USP, Unique Sports Products, Marketing und Vertriebs GmbH, Munich, Germany

[ * ] Notice: This patent is subject to a terminal disclaimer.

[21] Appl. No.: 09/317,610

[22] Filed: May 25, 1999

Related U.S. Application Data

[63] Continuation of application No. 09/100,125, Jun. 19, 1998, Pat. No. 5,937,546, which is a continuation of application No. 08/738,701, Oct. 28, 1996, Pat. No. 5,771,609, which is a continuation of application No. 08/547,429, Oct. 24, 1995, abandoned, which is a continuation of application No. 08/317,037, Oct. 3, 1994, abandoned.

[30] Foreign Application Priority Data

Oct. 1, 1993 [DE] Germany ..... 43 33 503

[51] Int. Cl.[7] ..... A43B 7/20

[52] U.S. Cl. ..... 36/89; 36/115; 36/117.8; 36/117.6; 36/117.7

[58] Field of Search ..... 36/89, 115, 117.8, 36/117.6, 117.7, 117.1, 88, 109, 143, 144, 118.2, 118.1, 118.9; 602/27, 65

[56] References Cited

U.S. PATENT DOCUMENTS

| | | | |
|---|---|---|---|
| 730,366 | 6/1903 | Gunthorp | 36/89 |
| 1,381,290 | 6/1921 | Diadul, Jr. | 602/27 |
| 3,530,594 | 9/1970 | Vogel | 36/2.5 |
| 3,597,862 | 8/1971 | Vogel | 36/2.5 |
| 3,807,062 | 4/1974 | Spier | 36/2.5 AL |
| 4,096,651 | 6/1978 | Ancker | 36/120 |
| 4,979,760 | 12/1990 | Derrah | 280/607 |
| 5,020,248 | 6/1991 | Hercog et al. | 36/89 |
| 5,090,138 | 2/1992 | Borden | 36/89 |
| 5,401,041 | 3/1995 | Jespersen | 280/14.2 |
| 5,435,080 | 7/1995 | Meiselman | 36/115 |
| 5,454,173 | 10/1995 | Falguere et al. | 36/117 |
| 5,499,461 | 3/1996 | Danezin et al. | 36/117 |
| 5,771,609 | 6/1998 | Messmer | 36/89 |
| 5,937,546 | 8/1999 | Messmer | 36/89 |

FOREIGN PATENT DOCUMENTS

| | | | |
|---|---|---|---|
| 28954 | 5/1925 | France | 36/89 |
| 3622746 | 1/1988 | Germany . | |

*Primary Examiner*—M. D. Patterson
*Attorney, Agent, or Firm*—Greenblum & Bernstein P.L.C.

[57] ABSTRACT

A snowboard boot for freestyle riding includes, as usual, a soft boot-shaped inside portion and a boot-shaped outside portion that is provided with a soft shaft. To transmit the force for backside turns with legs bent to the side, a rigid insert is provided between the inside portion and the outside portion that extends about the heel area. At the height of the ankle a rigid back portion embracing the calf is movable on the insert about an area positioned approximately in the longitudinal center plane of the boot.

28 Claims, 2 Drawing Sheets

1
2
3
4
5
6
7
8
9
10
11
12
13
16
17
19
21
22
23
24
25
26

SNOWBOARD BOOT WITH INNER STIFFENING ASSEMBLY

CROSS-REFERENCE TO RELATED APPLICATIONS

This is a continuation of application Ser. No. 09/100,125, filed on Jun. 19, 1998, now U.S. Pat. No. 5,937,546 which is a continuation of application Ser. No. 08/738,701, filed on Oct. 28, 1996, now U.S. Pat. No. 5,771,609, issued on Jun. 30, 1998, which is a continuation of application Ser. No. 08/547,429, filed on Oct. 24, 1995, now abandoned, which is a continuation of application No. 08/317,037, filed on Oct. 3, 1994, now abandoned. The disclosures of all of the aforementioned applications and patents are hereby incorporated by reference thereto in their entireties.

BACKGROUND OF THE INVENTION

1. Field of the Invention

The present invention relates to a snowboard boot having a soft boot-shaped inside portion and a boot-shaped outside portion that has a soft shaft.

2. Description of Background and Material Information

Depending upon whether one is riding alpine or freestyle, one uses essentially two types of boots and bindings in snowboarding.

For alpine snowboarding, one uses hard boots that, like ski boots, comprise a soft inside shoe and a hard plastic outer shell, the outer shell being provided on the calf with a high back portion or spoiler. The binding used is a plate-shaped binding designed like a ski tour binding.

The snowboarder stands transversely on the snowboard. That is, to do a curve he moves either forward ("frontside turn") or backward ("backside turn"). While the force that can be applied to the snowboard with the foot suffices for a frontside turn, there are problems with a backside turn for anatomical reasons. This is the reason for the spoiler, which acts as a lever.

In contrast to alpine snowboarding, the freestyle snowboarder should have high lateral mobility. This is, he should be able to bend his legs to the side quite far, possibly so far that he touches the snowboard with his knee.

Snowboard boots for freestyle riding have a soft, padded, boot-shaped inside portion, and the boot-shaped outside portion is provided with a soft cloth shaft. The freestyle or soft boot thus has substantially only a warming and cushioning function, while the foot is held on the snowboard and forces are transmitted from the foot to the snowboard by means of the binding. To permit backside turns to be performed with such a freestyle boot, the binding for these boots is provided with a spoiler. When the legs are bent to the side, they are turned out of the spoiler fastened on the binding. The spoiler thus loses effect, so that backside turns with legs bent to the side are very difficult to perform with the known freestyle boot and binding set.

SUMMARY OF THE INVENTION

An object of the invention is to provide a system for fastening the foot on the snowboard in such a way that backside turns can also be readily performed freestyle with legs bent to the side.

To this end, the invention is directed to a boot, particularly to a boot adapted for use during snowboarding, comprising:

an outer shell including a lower part adapted to surround at least a lower portion of the foot and an upper part extending upwardly from the lower part above the ankle;

an inner portion positioned within the lower and upper parts of the outer shell, the inner portion being made of a flexible material;

an insert positioned between the outer shell and the inner portion at least in a heel area, the insert being more rigid than both the outer shell and the inner portion;

a back portion positioned rearwardly of a calf area; and a structural connection approximately at the height of the ankle, for enabling lateral movement of the back portion with respect to the insert during use of the boot.

According to a feature of the invention, the inner portion and the upper part of the outer shell are preferably made of a flexible material, so as to flex in response to lateral movement of the rigid back portion with respect to the rigid insert.

According to another feature of the invention, the rear of the insert extends upwardly approximately to the height of the ankle.

According to a particular embodiment of the invention, the structural connection between the rigid insert and the rigid back portion comprises a pivot link, the pivot link providing a pivot axis positioned substantially in a longitudinal center plane of the boot, the rigid back portion thereby being laterally pivotable about the pivot axis.

According to an additional feature of the invention, at least one tensioning member is provided to extend between the rigid back portion, above the articulation, and the insert. In a preferred embodiment, a mechanism is provided to adjust the effective length of the tensioning member between the back portion and the insert for selectively adjusting a forward inclination of the rigid back portion.

According to a still further feature of the invention, a tensioning mechanism is provided for exerting a tensioning force at the rigid back portion above the articulation and at the insert in an area beneath the ball of the foot. Preferably, the tensioning mechanism comprises a lengthwise extending tensioning member and an adjustment mechanism for selectively vertically repositioning the tensioning member with respect to the rigid back portion.

According to a still further feature of the invention, the lower part and the upper part of the outer shell are non-articulated with respect to each other, and they are preferably formed unitarily.

According to specific embodiment of the invention, one uses a customary freestyle soft boot, providing between the inside portion and the outside portion of the boot an insert with a back portion linked thereto that embraces the calf and corresponds in its effect to a spoiler. The back portion pivots about an axis generally extending in the longitudinal direction of the boot and generally extending obliquely downward from the back to the front. The axis is disposed at the height of the ankle. To be able to be carried along by the calf when the legs are bent to the side, the back portion embraces the calf on both sides. The back portion thus develops its full effect as a spoiler regardless of the angular position of the legs with respect to the snowboard. Backside turns are therefore readily possible even when the legs are bent to a great degree.

To hold the back portion, one preferably provides a tension medium, e.g., a band that acts on the back portion, on the one hand, and on the ball of the foot area, on the other hand, generally on both sides of the insert. The point where the tension medium acts on the back portion is preferably adjustable in height.

Customary soft boots can be easily retrofitted with the inventive insert. For this purpose, one can, e.g., remove the inner sole between the inside portion and the outside portion that are generally present in customary soft boots. To provide enough room for the insert and the back portion, one can also use a boot half a size larger, for example.

BRIEF DESCRIPTION OF THE DRAWINGS

An embodiment of the inventive snowboard boot will be explained in more detail in the following with reference to the drawing, in which.

DETAILED DESCRIPTION OF THE INVENTION

Figure 1:
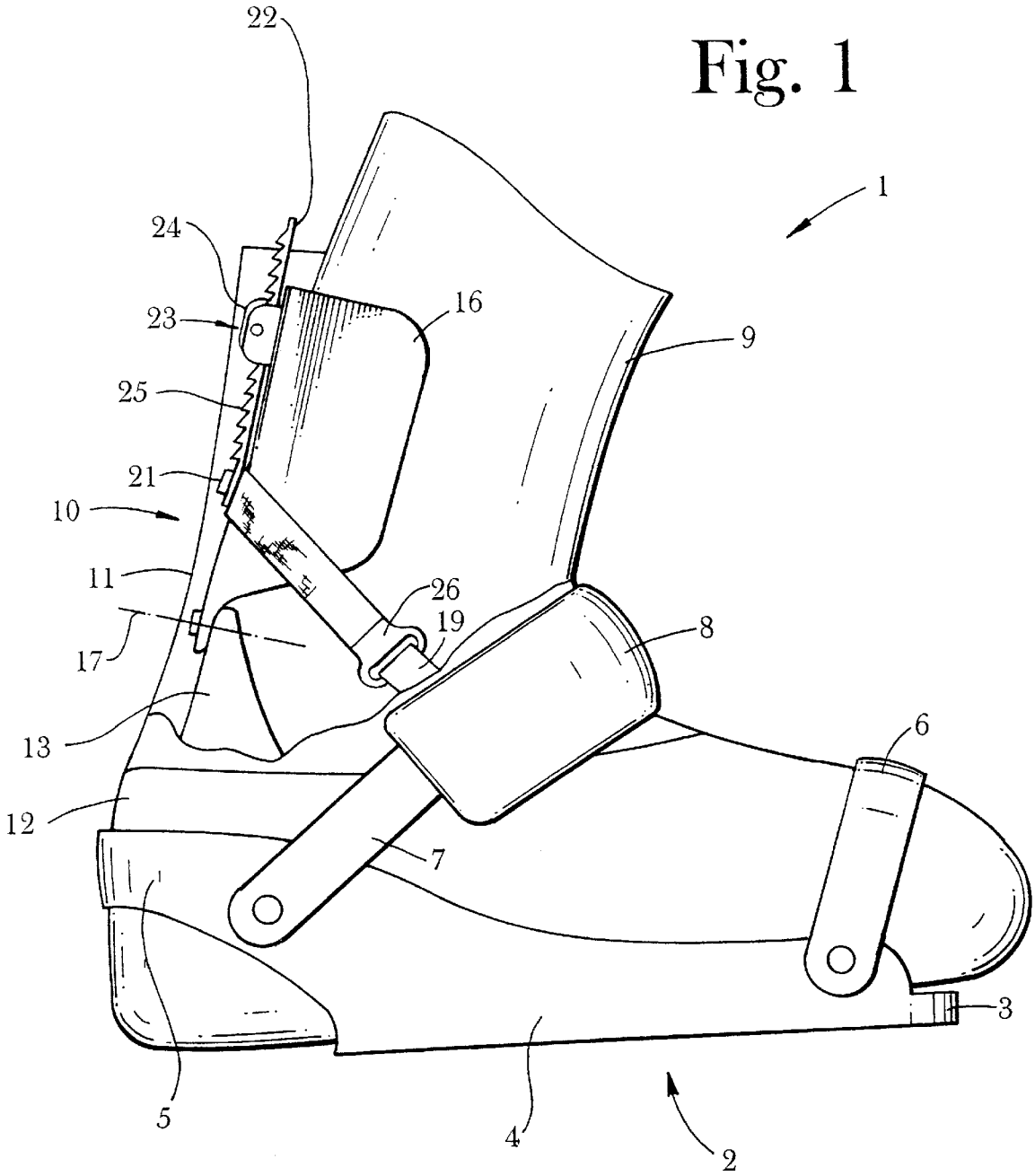
FIG. 1 shows a side view of the boot fastened on a binding with an outside portion shaft partly broken away.

According to FIG. 1, boot 1 is fastened on binding 2. Binding 2 comprises base plate 3 with side walls 4 on both sides. The side walls are interconnected at their back end with heel bar 5.

In the front area side walls 4 are connected by belt band 6 closable with a buckle (not shown) and disposed above the front toecap of boot 1. The side walls are further connected in the back area by instep band 7 that is provided with cushion 8. Instep band 7 is placed about the instep of boot 1 and likewise closable with a buckle (not shown). Binding 2 is fastened on the snowboard (not shown) with base plate 3.

Boot 1 comprises boot-shaped inside portion or inner shell or liner 9 and boot-shaped outside portion or outer shell 10. Inside portion 9 can be formed like the inside portion of a customary soft boot, i.e., mainly soft and padded. It can be laced and be provided with a tongue not shown in the drawing.

Outside portion or upper part 10 comprises shaft 11 that is partly broken away in FIG. 1, and lower part 12. Outside portion 10 can likewise be formed by the outside portion of a customary soft boot. That is, lower part 12 is made of rubber or a similar material, while shaft 11 is made of cloth or another flexible material, such as leather or felt. Shaft 11 is thus soft and flexible. Shaft 11 can likewise be laced and be provided with a tongue not shown in the drawing. The lower part 12 is adapted to enclose at least a lower portion of the foot; the upper edge of lower part 12 is located below the ankle.

Rigid insert 13 is disposed between inside portion 9 and outside portion 10. Insert 13 has a rigidity that is substantially greater than that of inside portion 9 and of shaft 11 of outside portion 10 and corresponds approximately to the rigidity of base plate 3 of binding 2 or is even higher. The wall thickness of insert 13 should be as small as possible and is preferably no more than 5 mm. Insert 13 can for this purpose be made, for example, of fiber-reinforced plastics, e.g., glass fiber reinforced epoxy resin or polyamide.

As is apparent from FIG. 2, insert 13 extends under the foot from ball area 14 to heel area 15, then about heel area 15 to below the calf, i.e., to the height of the ankle. The rear of the heel area 15 of the insert 13, i.e., behind the foot, can be regarded as an ankle stop. Insert 13 is saucer-shaped, i.e., it also encloses the foot and heel at the sides. Insert 13 is adapted to the foot.

Rigid back portion 16 is pivoted about axis 17 on the upwardly tapering end, or end tip, of insert 13. Axis 17 lies approximately in the longitudinal center plane of the boot and extends downward slightly obliquely in the forward direction. It is disposed at the height of the ankle.

In the illustrated embodiment, the articulation between insert 13 and back portion 16 can be formed by link pin 18, which can be a rivet, a screw connection or the like. Back portion or back plate 16 is saucer-shaped so that it embraces the sides of the calf.

Back portion 16 is likewise of rigid formation. That is, its rigidity is substantially greater than the rigidity of inside portion 9 or of shaft 11 of outside portion 10, but generally lower than the rigidity of base plate 3 of binding 2. The wall thickness of back portion 16 is likewise as small as possible, and should not exceed 5 mm. However, the rigidity of back portion 16 can be lower than the rigidity of insert 13. Back portion 16 is preferably made of non-fiber reinforced plastics, for example polyurethane or polyamide. Back portion 16 extends upward approximately to the upper edge of shaft 11 of outside portion 10. Back portion 16 is braced with ball of the foot area 14 of insert 13 by a tension medium or mechanism.

Figure 2:
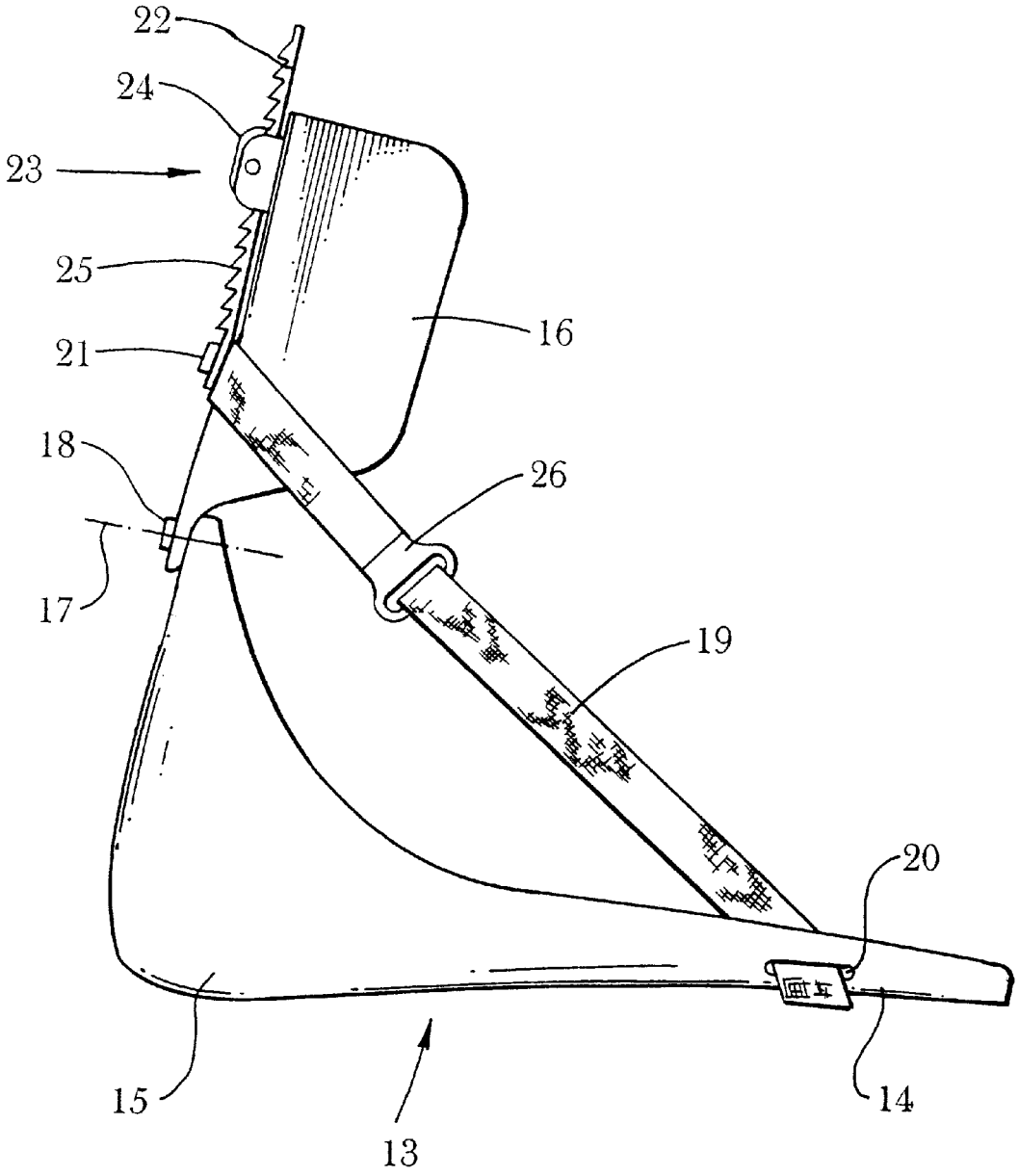
FIG. 2 shows a side view of the insert with the back portion linked thereto.

According to FIG. 2, belt band or tensioning member 19 is disposed for this purpose about back portion 16, being guided through slot 20 on the side wall in ball of the foot area 14 of insert 13, extending under insert 13 to the other side and extending through a corresponding slot in the other side wall and then to back portion 16.

For adjusting the length of band 19, between the back portion and the insert, the band is provided with buckle 26, the end of belt band 19 being inserted through buckle 26 and fixed with a closure or fastener not shown in the drawing. This fastener can be, for example, a VELCRO hook and loop fastener. A VELCRO fastener or closure has the advantage that it remains reliably fixed by the pressure between inside portion 9 and outside portion 10. One can possibly provide buckle 26 on each side of insert 13, inserting one end of band therethrough.

The position of belt band 19 with respect to back portion 16 can be made vertically adjustable. To this end, belt band 19 is fastened on the back of back portion 16, e.g., with rivet 16 on tongue 22 in the upper area of back portion 16. The locking means can consist, for example, of ratchet buckle 23 that has pawl arm 24 provided with a press button and cooperating with sawtooth ribs 25 on tongue 22.

Boot 1 comprising inside portion 9 and outside portion 10 has substantially only a warming and cushioning function. By contrast, the forces are transmitted from the foot to the snowboard with inventive boot 1 by insert 13 and back portion 16 by binding 2.

Since inside portion 9 and shaft 11 of outside portion 10 are soft, the snowboarder can bend his legs to the side in any desired way, possibly until he touches the snowboard with his knees. In freestyle riding, many movements are made sideways out of the knees. The snowboarder can thus readily perform all these movements with the inventive boot.

Because of its link to insert 13 about axis 17 and its formation as a member embracing the calf, rigid back portion 16 is carried along during all lateral movements of the calf. The back portion 16 is thus effective as a spoiler in every swivel position, so that backside turns can also be easily performed with the legs bent to the side.

As seen in the drawings, the boot, including the insert/back portion and the inner and outer portions, is inclined upwardly and forwardly. The inclination of back portion 16 with respect to the boot sole, i.e., base plate 3 of binding 2, can be adjusted via the length of belt band 19. When buckles 26 are provided on each side of insert 13, back portion 16 can also be put on a slant if this is desired.

The point where belt band 19 acts on back portion 16 can be adjusted in height with tongue 22. That is, when belt band 19 embraces back portion 16 relatively far down, back portion 16 is less rigid than when belt band 19 acts on the upper area of back portion 16. With a lower point of attack, one thus has more mobility in the boot, but must expend more energy to perform backside turns, while with a higher point of attack the mobility decreases, but there is better load transmission for backside turns. In this way, the snowboarder can adjust the mobility and the load transmission optimally in accordance with his needs and wishes.

What is claimed is:

1. A snowboard boot comprising:

an outer shell including a lower part adapted to surround at least a lower portion of the foot and an upper part extending upwardly from said lower part above an ankle area of the boot, said upper part comprising a flexible material;

an inner portion positioned within said lower and upper parts of said outer shell, said inner portion comprising a flexible material;

a rigid insert positioned between said outer shell and said inner portion at least in a heel area, a rear of said insert extending upwardly approximately to a height of the ankle area of the boot;

a rigid back portion positioned rearwardly of a calf area and extending upwardly above the ankle area of the boot; and a structural connection between said rigid insert and said rigid back portion, said structural connection enabling lateral movement of said rigid back portion with respect to said rigid insert during use of the boot, said inner portion and said upper part of said outer shell being comprised of a flexible material adapted to flex in response to lateral articulation of said rigid back portion.

2. A snowboard boot according to claim 1, wherein:

said structural connection between said rigid insert and said rigid back portion provides for movement of said rigid insert around an area lying substantially in a longitudinal center plane of the boot.

3. A snowboard boot according to claim 1, further comprising:

a tensioning member extending between said rigid back portion, above said structural connection, and said insert.

4. A snowboard boot according to claim 3, further comprising:

a mechanism for adjusting an effective length of said tensioning member between said back portion and said insert for selectively adjusting a forward inclination of said rigid back portion.

5. A snowboard boot according to claim 1, further comprising:

a tensioning mechanism for exerting a tensioning force at said rigid back portion above said structural connection and at said insert in an area beneath the ball of the foot.

6. A snowboard boot according to claim 5, wherein:

said tensioning mechanism comprises a lengthwise extending tensioning member, said tensioning mechanism further comprising an adjustment mechanism for selectively vertically repositioning said tensioning member with respect to said rigid back portion.

7. A snowboard boot according to claim 1, wherein:

said lower part and said upper part are non-articulated with respect to each other.

8. A snowboard boot according to claim 1, wherein:

said lower part and said upper art are unitary with respect to each other.

9. A boot adapted to be worn for snowboarding, the boot being configured to encase the foot, the ankle, and the lower calf, the boot comprising:

an outer shell having a lower section shaped to encase the foot and a shaft section that extends upwardly from the lower section so as to encase the ankle and the lower calf;

an inner shell comprising a flexible material disposed in the outer shell;

an inner insert positioned between the outer shell and the inner shell at least in a heel area, said insert comprising a material having a rigidity greater than a rigidity of said inner portion;

a back portion positioned rearwardly of a calf area, extending above a height of an ankle area of the boot, said back portion being structurally connected to said insert to enable movement of said insert around an area lying substantially in a longitudinal center plane of the boot during use of the boot, the inner portion and the shaft section of the outer shell at least having portions comprised of a flexible material adapted to flex in response to lateral movement of said back portion.

10. A boot comprising:

an outer shell including a lower part adapted to surround at least a lower portion of the foot and an upper part extending upwardly from said lower part;

a liner positioned within said outer shell;

an insert positioned between said outer shell and said liner, said insert being more rigid than said outer shell and more rigid than said liner, said insert having an end portion behind a heel area;

a back portion extending rearwardly of a calf area and extending above said insert; and a structural connection behind said calf area, connecting said back portion and said end portion of said insert, said structural connection being located in an area of an ankle of the boot.

11. A boot according to claim 10, wherein:

said end portion of said insert extends upwardly at least to a height of the ankle area of the boot.

12. A boot according to claim 10, wherein:

said structural connection defines a substantially longitudinally extending pivot axis between said back portion and said end portion of said insert.

13. A boot according to claim 10, wherein:

said structural connection defines a pivot axis between said back portion and said end portion of said insert, extending substantially longitudinally and downwardly from front to back.

14. A boot according to claim 10, wherein:

said structural connection defines an articulation between said back portion and said end portion of said insert, extending substantially longitudinally and downwardly from front to back.

15. A snowboard boot according to claim 1, wherein:

said structural connection between said rigid insert and said rigid back portion is located approximately at the height of the ankle area of the boot.

16. A boot comprising:

an outer shell including a lower part adapted to surround at least a lower portion of the foot and an upper part extending upwardly from said lower part above the ankle, at least a portion of said upper part being made of a material which is flexible;

an inner portion positioned within said lower and upper parts of said outer shell, at least a portion of said inner portion being made of a material which is flexible;

a insert positioned between said outer shell and said inner portion at least in a heel area, a rear of said insert extending upwardly at least to approximately a height of an ankle area of the boot, a rigidity of said insert being substantially greater than a rigidity of said inner portion;

a back portion having a rigidity which is substantially greater than a rigidity of said inner portion and positioned rearwardly of a calf area, said back portion being structurally connected to said insert to enable lateral movement of said back portion with respect to said insert during use of the boot, at least a portion of the material which is flexible of said inner portion and at least a portion of said material which is flexible of said outer shell being able to flex in response to the lateral movement of said rigid back portion.

17. A boot according to claim 16, wherein:

a rear portion of said back portion is connected to a rear portion of said insert.

18. A boot according to claim 17, wherein:

a front surface of the rear portion of said back portion faces a rear surface of the rear portion of said insert.

19. A boot according to claim 18, wherein:

a front surface of the rear portion of said back portion contacts a rear surface of the rear portion of said insert.

20. A boot according to claim 16, wherein:

the rear portion of said back portion is connected to the rear portion of said insert by a link pin.

21. A boot according to claim 16, wherein:

the rear portion of said back portion is connected to the rear portion by a means for connecting.

22. A boot according to claim 16, wherein:

said lateral movement of the back portion with respect to the insert comprises a rotational movement.

23. A boot according to claim 18, wherein:

said lateral movement of the back portion with respect to the insert comprises a rotational movement.

24. A boot according to claim 19, further comprising:

at least one strap connected between the insert and the back portion.

25. A boot according to claim 16, further comprising:

at least one strap connected between the insert and the back portion.

26. A boot according to claim 25, wherein:

said at least one strap comprises two straps connected between the insert and the back portion, one of said two straps connected between a left side of the insert and a left side of the back portion, and another of said two straps connected between a right side of the insert and a right side of the back portion.

27. A boot according to claim 25, further comprising:

a mechanism for adjusting an effective length of said strap between said back portion and said insert for selectively adjusting a forward inclination of said rigid back support.

28. A boot comprising:

an outer shell including a lower part adapted to surround at least a lower portion of the foot and an upper part extending upwardly from said lower part;

a liner positioned within said outer shell;

an insert positioned between said outer shell and said liner, said insert comprising a material more rigid than a material of said outer shell and more rigid than a material of said liner, said insert having an end portion behind a heel area;

a back portion extending rearwardly of a calf area and extending above said insert and being structurally connected to said insert at a location at an ankle area of the boot.

* * * * *